United States Patent [19]

Sur et al.

[11] 4,076,470

[45] Feb. 28, 1978

[54] PLANETARY AIR MOTOR WITH TWO INTERNAL GEARINGS

[76] Inventors: Mikhail Danilovich Sur, ulitsa Anri Barbjusa, 22/26, kv. 28; Daniil Andreevich Dudko, ulitsa Anri Barbjusa, 22/26, kv. 143, both of Kiev, U.S.S.R.

[21] Appl. No.: 728,023

[22] Filed: Sep. 30, 1976

[51] Int. Cl.[2] ..... F01C 1/08; F01C 21/12

[52] U.S. Cl. ..... 418/63; 418/186

[58] Field of Search ..... 418/54, 63, 66, 186–188

[56] References Cited

U.S. PATENT DOCUMENTS

| | | | |
|---|---|---|---|
| 252,372 | 1/1882 | Hardy | 418/187 |
| 267,174 | 11/1882 | Fitts et al. | 418/54 |
| 969,478 | 9/1910 | Humphreys | 418/54 |
| 1,009,362 | 11/1911 | Wester | 418/186 |
| 3,367,239 | 2/1968 | Takagi | 418/54 |
| 3,832,098 | 8/1974 | Dudko et al. | 418/186 |
| 3,836,292 | 9/1974 | Dudko et al. | 418/186 |

*Primary Examiner*—John J. Vrablik

*Attorney, Agent, or Firm*—Haseltine, Lake & Waters

[57] ABSTRACT

A planetary air motor with two internal gearings employing two internally toothed ring gears. One ring gear rotates and meshes with a first rim of a two-rim pinion, the other gear forms an intertooth space with a second rim of the pinion that is freely mounted on an eccentric journal of a pinion carrier and has radial through slots in the tooth spaces. The intertooth space is limited by a flange at one face and by a fixed washer at the other face of the fixed gear and is divided into two intertooth working zones A and B. Zone A communicates with the compressed air line and the other one (B) with the atmosphere. The pinion carrier has a main channel and an additional channel with an inside bore that is smaller than that of the main channel and which is isolated from the latter. The additional channel is disposed towards the periphery of an eccentric journal of the pinion carrier and communicates with the compressed air line and the intertooth working zone A through a slot in the pinion carrier. The slot is where the fixed ring gear meshes with the pinion rim and is tangential to the cross section of the additional longitudinal channel. The main channel communicates with atmosphere through side holes in the pinion carrier, and zone B through a side port located in the zone where the fixed ring gear meshes with the other rim of the pinion.

4 Claims, 3 Drawing Figures

PLANETARY AIR MOTOR WITH TWO INTERNAL GEARINGS

The present invention relates to general machine-building and more particularly it relates to planetary air motors with two internal gearings.

The invention can be used to advantage in the drives of hand-operated tools, in mining machines, etc., where small size and weight, durability and powerful torque on the output shaft, simplicity and high dependability are of major importance.

The present invention will be employed most successfully in welding equipment for feeding welding wire into the welding zone.

At present an urgent problem in the welding equipment is creation of a dependable compact and powerful pneumatic drive to be used in the mechanism of feeding the welding wire into the welding zone. A Swedish firm "ESAB" has devised a pneumatic drive used to feed the welding wire into the welding zone.

However, this pneumatic drive is very heavy which hinders the work of the welding operator and cuts down output. Besides, this pneumatic drive incorporates a rotary motor with quick-wearing vanes. Vane wear is accelerated by the use of an insufficiently clean air of welding shops. The feeding of wire into the welding zone calls for a reduction in the angular speed of the rotary motor which necessitates introduction of a heavy step-down speed reducer.

Therefore, the mechanism for feeding welding wire should incorporate a gear-type air motor which is more sturdy in operation and can be easily driven by the compressed air of the workshop air system.

This problem has already been solved in a number of countries by developing planetary air motors which combine simplicity and reliability of gear-type air motors with a low speed and a high torque at the output shaft which are necessary for feeding welding wire into the welding zone.

The known planetary air motor with two internal gearings comprises a casing which accommodates a pinion with an external rim meshing with a fixed internally toothed ring gear thus forming an intertooth working space. The pinion has one more rim with internal teeth meshing with a rotatable ring gear which is coupled to the output shaft of the motor.

The internal rim is enveloped by an external rim. The intertooth space is divided into working zones by a minimum clearance between the tooth points of the pinion rim and the fixed sun wheel.

The faces of the fixed sun wheel and external rim fit closely against fixed discs which are provided with a number of holes which are intended to put each intertooth working zone in communication with the high- and low-pressure lines of the working medium.

The external rim of the pinion has a number of holes some of which communicate with the holes in the disc leading to the high-pressure intertooth working zone while the other holes are in communication with the low-pressure intertooth working zone.

The working medium is supplied into the intertooth working zone from one face of one disc and discharged from the other face of the other disc from the other intertooth working zone.

The delivery and discharge of the working medium into and from the intertooth working zones at the disc faces calls for increasing the outside diameter and weight of the motor. Besides, in the face delivery the tooth spaces are incompletely filled with the working medium which can be traced to the effect of centrifugal forces on the pinion, said forces tending to throw the working medium towards the tooth points.

Incomplete filling of the tooth spaces with the working medium reduces the volumetric efficiency of the motor. Further, the face delivery and discharge of the working medium to and from the intertooth working zones has one more disadvantage, namely, due to a difference of pressures of the working medium at the delivery and discharge sides the pinion becomes cocked which disturbs the face clearance between the pinion and one disc, between the fixed ring gear and the other disc, eventually increasing the face leaks and reducing the volumetric efficiency.

The air motor described above has a low mechanical efficiency because of the unbalanced pinion which rotates at a high angular speed. This creates a considerable centrifugal force imposing additional dynamic loads on the bearing supports of the pinion carrier, said loads accelerating the ultimate failure of the bearings and causing motor vibrations.

The problem of increasing the volumetric efficiency has been partly solved by providing planetary air motors with radial admission and discharge of the working medium.

The planetary air motor comprises a casing which accommodates ring gears with internal teeth. One of the ring gears is installed rotatably and meshes with one rim of a two-rim pinion while the other ring gear is fixed and forms a working intertooth space with the other rim of the pinion. Said other rim of the pinion has radial through slots in the tooth spaces. The two-rim pinion is free-mounted on the eccentric journal of a pinion carrier. Said pinion carrier has a longitudinal through channel which is divided into two pressuretight spaces of an equal passage area by an inclined partition in the zone where the fixed sun wheel meshes with the pinion rim.

These two pressuretight spaces communicate, respectively, with the high-pressure and low-pressure lines of the working medium. The tooth faces of the fixed ring gear and pinion rim adjoin the pinion carrier flange at one side and a washer at the other.

In the diametral plane the intertooth space is divided into two working zones by the crescent-shaped plate of the pinion carrier. The working zones communicate with the high-pressure and low-pressure lines of the working medium through two side ports of the pinion carrier. One of these ports is located in the zone where the fixed ring gear meshes with the pinion rim; said port communicates with said high-pressure space of the working medium in the pinion carrier and delivers the working medium via the radial through slots in the tooth spaces of the pinion rim to the high-pressure working intertooth zone. Flowing through another port in the pinion carrier located in the zone where the fixed ring gear meshes with the pinion rim and communicating with the other space in the pinion carrier, the working medium leaves the low-pressure working zone through radial through slots in the pinion and flows into the low-pressure line of the working medium. The passage areas through the pinion carrier ports are identical.

The known planetary air motor has an insufficiently high volumetric efficiency when it is operated from an air line. The compressed air flowing through the longitudinal channel in the pinion carrier possesses insufficient kinetic energy owing to a comparatively large passage area through said channel. Then the stream of air flowing from the high-pressure space of the pinion carrier longitudinal channel into its side port acts on the pinion with a minimum force and radius of force application which reduces the torque on the pinion carrier and, consequently, the power on the output shaft of the motor.

The delivered compressed air acts on the entire surface of the pinion carrier flange which produces a strong axial force on the pinion and pinion carrier bearings thus reducing their life and the mechanical efficiency of the motor.

An object of the present invention resides in raising the volumetric efficiency of the planetary air motor with two internal gearings.

Another object of the present invention resides in increasing the mechanical efficiency.

Still another object of the present invention resides in increasing power on the output shaft of the motor.

In accordance with these and other objects the essence of the present invention lies in providing a planetary air motor with two internal gearings comprising a casing which accommodates two internally toothed ring gears one of which is mounted rotatably and meshes with one rim of a two-rim pinion whereas the other ring gears is fixed and forms a working intertooth space with the other rim of the pinion which is provided with radial through slots in the tooth spaces and is free-mounted on the eccentric journal of a pinion carrier having the main longitudinal channel, said working intertooth space being limited by the flange of the pinion carrier at one face of the fixed ring gear and by a fixed washer at its other face, and being divided by a crescent-shaped plate of the pinion carrier into two intertooth working zones which are practically isolated from each other and communicate, respectively, with a compressed air line and the atmosphere wherein, according to the invention, the pinion carrier has a slot in the zone where the fixed sun wheel meshes with one rim of the pinion and an additional longitudinal channel of a smaller passage area than said main channel, is isolated from said main channel, arranged in a diametrical plane towards the periphery of the eccentric journal of the pinion carrier and communicates with the compressed air line and the intertooth working zone through said slot set tangentially to the cross section of said additional channel, the length of said slot being equal to the width of the radial channels in the tooth spaces of the rim of the pinion which meshes with the fixed sun wheel while the main channel in the pinion carrier communicates with the atmosphere through side holes located in the zone where the rotatable ring gear meshes with the pinion rim and with the other intertooth working zone through a side port in the pinion carrier, said port being located in the zone where the fixed ring gear meshes with one rim of the pinion, the length of said port being equal to the length of the slot, and being limited in cross section by the side located at an angle of 120° approximately to a horizontal plane passing through the centre of the eccentric journal of the pinion carrier.

Due to the provision of an additional longitudinal channel in the pinion carrier with the passage area smaller than that of the main channel, the velocity of compressed air grows and, as a consequence, its kinetic energy increases thus raising the mechanical efficiency.

A slot made in the pinion carrier increases the kinetic energy of compressed air still more and creates a pressure head on the surface of the radial through slots in the tooth spaces of the pinion rim which also increases mechanical efficiency.

The location of said slot as near as possible to the periphery of the eccentric journal of the pinion carrier increases the arm of force of the compressed air stream and, consequently, the torque on the pinion carrier while the location of the slot tangentially to the cross section of the additional longitudinal channel of the pinion carrier increases the component of the force acting on the surfaces of the radial through slots in the tooth spaces of the pinion and, consequently, increases the torque on said pinion which eventually raises the power on the output shaft of the motor.

Arrangement of the side port in the pinion carrier which communicates the space of the main channel with the atmosphere at an angle of 120° approximately relative to the horizontal plane provides for a free escape of the used air from the working intertooth zone which reduces local resistance and assists in the unobstructed escape of the compressed air caught by the pinion teeth from the high-pressure intertooth working zone into the atmosphere which increases the volumetric efficiency of the motor.

It is recommended that the pinion carrier comprising two concentric journals for the bearing supports should have a concentric cylindrical space in one of said journals, said space communicating with an additional channel of the pinion carrier and accommodating a bushing with a minimum clearance, said bushing being rigidly fastened on the casing and provided with a through channel communicating with a compressed air line, the main channel of the pinion carrier being tightly closed with a plug.

The provision of the bushing rigidly secured on the casing and entering the concentric space in the pinion carrier with a minimum clearance allows a reduction in the cross section of the pinion carrier subjected to the pressure of compressed air. This decreases the axial load on the bearing supports of the pinion carrier and reduces mechanical losses.

It is a good practice if the intertooth working zone communicating with the atmosphere would communicate additionally with the atmosphere through a shaped port in the pinion carrier flange, said port being limited in cross section by two radiuses, one drawn from the motor centre and being equal to the radius of the dedendum circle of the fixed ring gear and the other one drawn from the centre of the eccentric journal of the pinion carrier and being equal to radius of the dedendum circle of the rim of the pinion meshing with the fixed ring gear, while in the radial direction the shaped port is limited by an angle of 45° approximately to the diametral plane at one side and by the meshing of said fixed ring gear with the corresponding rim of the pinion at the other.

The additional port in the pinion carrier flange, communicating with the low-pressure intertooth working zone shortens the path of the air flowing from the working zone into the atmosphere, reduces the local resistances and increases the volumetric efficiency of the motor.

The air motor according to the invention can be used in welding equipment, particularly in the mechanism for feeding the welding wire into the welding zone (in the semiautomatic machines of the "pull", "pull-push" and "push" type, in automatic welders, apparatuses and installations). Besides, the air motor according to the invention can be employed widely in various branches of general machine building e.g., in hand-operated pneumatic tools, in the drives of wood-working machines, mining machines, etc., i.e., in applications calling for small size, durability of the drives and a high torque on the output shaft.

The pneumatic drive according to the invention has a wide range of speed ratios (practically from 20 to 1000), is easily standardized and distinguished by a minimum weight and small dimensions.

Other objects and advantages of the invention will become more apparent from the detailed description of the invention by way of example of its realization with reference to the accompanying drawings in which.

Figure 1:
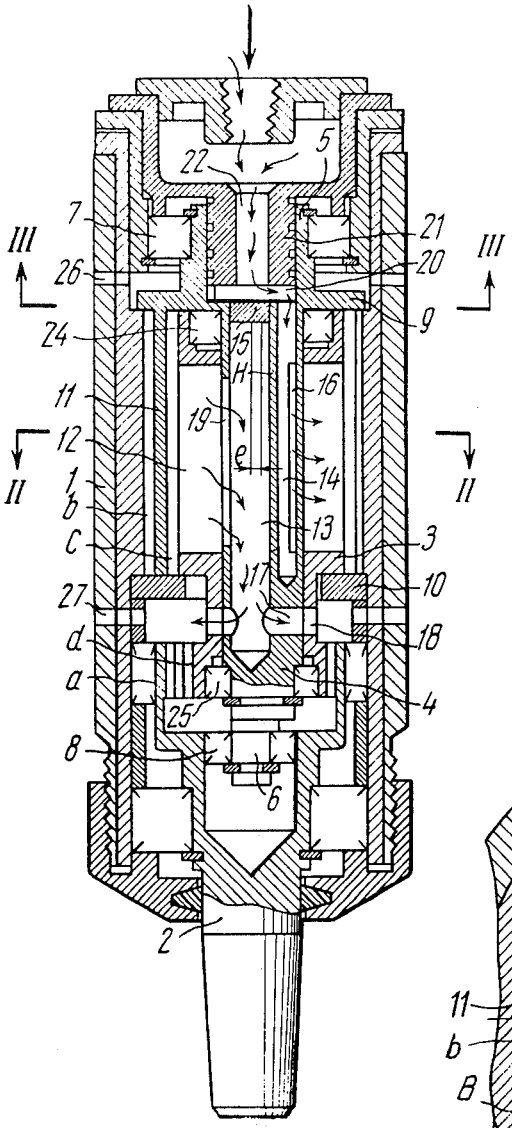
FIG. 1 is a longitudinal section through the planetary air motor with two internal gearings according to the invention.

The planetary air motor with two internal gearings according to the invention comprises a casing 1 (FIG. 1) which accommodates two ring gear "*a*" and "*b*" with internal teeth. The ring gear "*a*" is capable of rotating and is rigidly connected with the output shaft 2 of the motor. The ring gear "*b*" is fixed and meshes with one rim "*c*" of a two-rim pinion 3. The latter is free-mounted on the eccentric journal 4 of the pinion carrier "H." The other rim "*d*" of the pinion 3 is in mesh with the ring gear "*a*". The other rim "*d*" of the pinion 3 is in mesh with the ring gear "*a*. " The pinion carrier "H" has two concentric journals 5 and 6 mounting the bearing supports 7 and 8 and one eccentric journal 4. The ring gear "*b*"and the rim "*c*" form an intertooth working space. Said space is limited by the flange 9 of the pinion carrier "H" at one face of the fixed ring gear "*b*" and by a fixed washer 10 at its other face.

Figure 2:
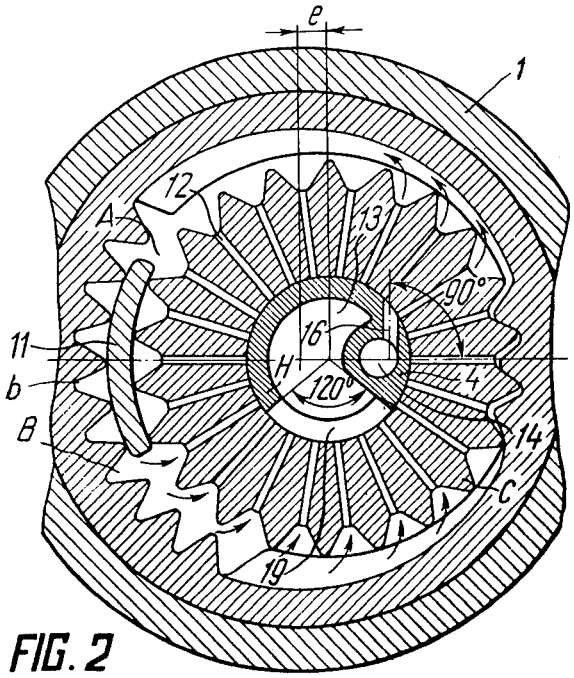
FIG. 2 is a section II in FIG. 1, enlarged.

The intertooth working space is divided by a crescent-shaped plate 11 of the pinion carrier "H" into two working zones "A" (FIG. 2) and "B" which are practically isolated from each other, the zone "A" communicating with the compressed air line (not shown in the drawing) and the zone "B" communicating with the atmosphere. The tooth spaces of the rim "*c*" of the pinion 3 are provided with radial through slots 12.

The pinion carrier "H" has a main longitudinal channel 13 and an additional longitudinal channel 14; the channel 14 has a smaller passage area than the main channel 13 and is isolated from the latter. The channel 14 is set in a diametral plane toward the periphery of the eccentric journal 4 of the pinion carrier "H" and communicates with the compressed air line, the channel 14 being closed with a plug 15 (FIG. 1).

The working zone "A" (FIG. 2) is in communication with the compressed air line through a slot 16 in the pinion carrier "H"; said slot is located in the zone where the fixed sun wheel "*b*" meshes with the rim "*c*" of the pinion 3, is set tangentially to the cross section of the additional channel 14 and its length is equal to the length of the radial slots 12. The main channel 13 in the pinion carrier "H" communicates with the atmosphere through side holes 17 (FIG. 1) in the pinion carrier "H" and through holes 18 in the pinion 3, said holes being located in the zone where the rotatable sun wheel "*a*" meshes with the rim "*d*" of the pinion.

The ensure communication of the working intertooth zone "B" (FIG.2) with the atmosphere, the pinion carrier "H" is provided with a side port 19 located in the zone where the fixed ring gear "*b*" meshes with the rim "*c*" of the pinion; the length of said port is equal to that of the slot 16 and in the cross section this port is limited by a side set at an angle of 120°.

The concentric journal 5 (FIG. 1) of the pinion carrier "H"is provided with a cylindrical space 20 which communicates with the additional channel 14 and accommodates a bushing 21 which is set with a minimum clearance, is rigidly secured on the casing 1 and has a through channel 22; the latter communicates with the compressed air line.

Figure 3:
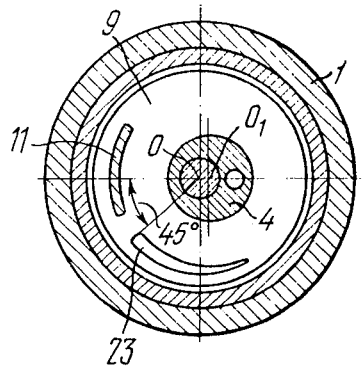
FIG. 3 is a section III in FIG. 1.

To increase the volumetric efficiency of the motor, the intertooth space "B" is additionally communicated with the atmosphere via a shaped through port 23 (FIG. 3) made in the flange 9 of the pinion carrier "H".

This port 23 is limited in cross section by two radiuses one of which is drawn from the center O of the motor and is equal to the radius of the dedendum circle of the fixed ring gear "*b*" (FIG. 1) while the other one is drawn from the center $O_1$ (FIG. 3) of the eccentric journal 4 of the pinion carrier "H" and is equal to the radius of the dedendum circle of the rim "*c*" of the pinion; in the radial direction the port 23 is limited by the meshing of said sun wheel "*b*" with the rim "*c*"of the pinion at one side and by an angle of 45° approximately relative to the diametral plate at the other.

The bushing 21 (FIG. 1) is installed with a minimum clearance which ensures a seal between the rotating concentric journal 5 of the pinion carrier "H" and the fixed bushing 21.

The pinion 3 is free-mounted on the bearing supports 24 and 25.

The eccentric journal 4 of the pinion carrier "H" has an eccentricity "*E*."

The casing 1 has holes 26 communicating with the port 23 and it has ports 27 for communication with the holes 17 and 18.

The motor operates as follows. Compressed air enters the casing 1 from the workshop air line. Here, the compressed air acts uniformly in all directions and exerts pressure on the rigidly secured bushing 21 and on a part of the surface of the pinion carrier "H" limited by the area of the cylindrical space 20. This reduces the axial load applied to the bearing supports 7 and 8 of the pinion carrier "H" and to the bearing supports 24 and 25 of the pinion 3 which raises the mechanical efficiency of the motor. Then the compressed air flows via the through channel 22 of the bushing 21 and enters the cylindrical space 20 from which it moves through a narrow additional channel 14 to the side slot 16. Due to a smaller passage area through the additional channel 14, the compressed air is accelerated and its kinetic energy increases. From the additional longitudinal channel 14 the compressed air flows into the side slot 16 which is set tangentially to the cross section of said channel 14. Then the air flows through the radial slots 12 of the pinion 3 into the intertooth working zone A. Inasmuch as said space is closed from all sides, the compressed air acts on the pinion 3.

The force of the compressed air stream leaving the slot 16 acts on a large arm because said slot 16 in set in a diametral plane towards the periphery of the eccentric journal 4 of the pinion carrier "H" which increases the torque on the pinion carrier "H."

Simultaneously, the same stream of compressed air acts at a certain angle on the surface of the radial through slots 12 in the tooth spaces of the rim "*c*" of the pinion 3 thus increasing the component which increases the torque on the pinion; all this, taken together, increases power on the output shaft 2 of the motor.

The intertooth working zone B is in communication with the atmosphere. The pressure differential in the intertooth working zones "A" and "B" and the eccentricity "*e*" create a torque on the pinion carrier "H" which is transmitted by the pinion 3 and the rotatable sun wheel "*a*" to the output shaft of the motor. The teeth of the rim "*c*" of the pinion 3 catch the compressed air and carry it into the atmospheric pressure zone B wherefrom the air escapes into the atmosphere via two routes, the first route is through the radial slots 12, side port 19, main channel 13 and holes 17, 18 and the second route is through the shaped port 23 and holes 26. Free escape of the compressed air from the zone "B" into the atmosphere via two routes reduces local resistances thus increasing the volumetric efficiency of the motor.

What we claim is:

1. A planetary air motor with two internal gearings comprising: a casing; two internally toothed ring gears accommodated in said casing, one of said ring gears being fixed while the other one is rotatable and intended to transmit torque to the shaft of a driven unit; a pinion carrier with a flange and a crescent-shaped plate, said pinion carrier being located in said casing and provided with two concentric journals, an eccentric journal, a main longitudinal channel, an additional longitudinal channel with a smaller bore than that of the main channel, said additional channel being isolated from the main channel and positioned in a diametral plane towards the periphery of said eccentric journal of the pinion carrier; a fixed washer installed in said casing; a two-rim pinion located in said casing and mounted on said pinion carrier; one rim of said pinion meshing with said rotatable ring gear and installed on one of said concentric journals of the pinion carrier; the other rim of said pinion free-mounted on said eccentric journal of the pinion carrier, provided with radial through slots in the tooth spaces; meshing with said fixed ring gear and forming, together with it, a working inter-tooth space; said intertooth working space limited by said flange of said pinion carrier at one face of said fixed ring gear and by said fixed washer at the other face, and divided by said crescent-shaped plate into two intertooth working zones practically isolated from each other, a compressed air line communicating with said additional longitudinal channel; said pinion carrier provided with a slot located in the zone where said fixed ring gear meshes with one of said pinion rims, said slot communicating with said additional channel and being set tangentially to the cross section of said additional channel, having a length equal to the width of said radial through slots in the tooth spaces of said pinion and putting said additional longitudinal channel in communication with one of said intertooth working zones; said pinion provided with side holes located in the zone where said rotatable ring gear meshes with said pinion rim and putting said main longitudinal channel in communication with the atmosphere, and a side port communicating said main longitudinal channel with the other one of said intertooth working zones, said port being located in the zone where said fixed ring gear meshes with said pinion rim, the length of said port being equal to the length of said radial through slots, said port being limited in cross section by a side set at an angle of 120° approximately.

2. A planetary air motor according to claim 1 wherein said pinion carrier has a shaped through port for additional communication between said other intertooth working zone and the atmosphere, said port being made in said pinion carrier flange, limited in cross section by two radiuses, one drawn from the motor center and equal to the radius of the dedendum circle of said fixed ring gear and the other one drawn from the center of said eccentric journal of the pinion carrier and equal to the radius of the dedendum circle of said pinion rim meshing with said fixed ring gear while in the radial direction said port is limited by an angle of 45° approximately relative to the diametral plane at one side and by the meshing of said fixed ring gear with said pinion rim at the other.

3. A planetary air motor according to claim 1 comprising: a bushing rigidly secured on said casing and provided with a longitudinal through channel communicating with said compressed air line; said other concentric journal of the pinion carrier which is free, has a concentric cylindrical space communicating with said additional longitudinal channel and accommodating said bushing which is set therein with a minimum clearance; a plug closing tightly said main longitudinal channel at the side of said bushing.

4. A planetary air motor according to claim 2 wherein said pinion carrier has a shaped through port for additional communication between said other intertooth working zone and the atmosphere, said port being made in said pinion carrier flange, limited in cross section by two radiuses, one drawn from the motor centre and equal to the radius of the dedendum circle of said fixed ring gear and the other one drawn from the center of said eccentric journal of the pinion carrier and equal to the radius of the dedendum circle of said pinion rim meshing with said fixed ring gear while in the radial direction said port is limited by an angle of 45° approximately relative to the diametral plane at one side and by the meshing of said fixed ring gear with said pinion rim at the other.

* * * * *